US009060398B2

(12) United States Patent
Deppe et al.

(10) Patent No.: US 9,060,398 B2
(45) Date of Patent: Jun. 16, 2015

(54) LIGHTING DEVICE EMPLOYING AC-DRIVEN LIGHT-EMITTING DIODES

(71) Applicant: Koninklijke Philips Electronics N.V., Eindhoven (NL)

(72) Inventors: Carsten Deppe, Aachen (DE); Matthias Wendt, Würselen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/786,585

(22) Filed: Mar. 6, 2013

(65) Prior Publication Data

US 2013/0181633 A1 Jul. 18, 2013

Related U.S. Application Data

(63) Continuation of application No. 13/334,118, filed on Dec. 22, 2011, now Pat. No. 8,456,089, which is a continuation of application No. PCT/IB2005/051814 on Jun. 3, 2005, now Pat. No. 8,084,945.

(30) Foreign Application Priority Data

Jun. 3, 2004 (EP) ..... 04102482

(51) Int. Cl.
*H05B 41/36* (2006.01)
*H05B 33/08* (2006.01)

(52) U.S. Cl.
CPC ..... *H05B 33/0821* (2013.01); *H05B 33/0803* (2013.01); *H05B 33/0809* (2013.01); *H05B 33/0827* (2013.01); *Y10S 362/80* (2013.01)

(58) Field of Classification Search
USPC ..... 315/32, 194–196
See application file for complete search history.

(56) References Cited

U.S. PATENT DOCUMENTS

| | | | |
|---|---|---|---|
| 3,869,641 | A | 3/1975 | Goldberg |
| 4,032,802 | A | 6/1977 | Pan et al. |
| 5,803,579 | A | 9/1998 | Turnbull et al. |
| 5,963,599 | A | 10/1999 | Curtis et al. |
| 6,337,536 | B1 | 1/2002 | Matsubara et al. |
| 6,388,393 | B1 | 5/2002 | Illingworth |
| 6,411,045 | B1 | 6/2002 | Nerone |
| 6,461,019 | B1 | 10/2002 | Allen |
| 6,636,027 | B1 | 10/2003 | Nerone |
| 2002/0097000 | A1 | 7/2002 | Muthu et al. |
| 2003/0112229 | A1 | 6/2003 | Pong et al. |
| 2003/0122502 | A1 | 7/2003 | Clauberg et al. |
| 2004/0183472 | A1 * | 9/2004 | Kamoi et al. ..... 315/291 |

(Continued)

FOREIGN PATENT DOCUMENTS

| | | | |
|---|---|---|---|
| GB | 2252685 | A | 8/1992 |
| JP | 1103356 | A | 9/1976 |
| JP | 51103356 | A | 9/1976 |

(Continued)

*Primary Examiner* — Douglas W Owens
*Assistant Examiner* — Jianzi Chen
(74) *Attorney, Agent, or Firm* — Yuliya Mathis

(57) ABSTRACT

Disclosed is a lighting device including a circuit including at least two parallel-connected light-emitting diodes of opposite pole in a first parallel branch and comprising at least two parallel-connected light-emitting diodes of opposite pole in a second parallel branch, and also including a capacitor and a coil. At least one of the diodes emits red light, blue light, and/or white light.

12 Claims, 5 Drawing Sheets

(56) References Cited

U.S. PATENT DOCUMENTS

| | | | | |
|---|---|---|---|---|
| 2004/0201990 | A1 | 10/2004 | Meyer | |
| 2007/0080652 | A1 * | 4/2007 | Elferich et al. | 315/291 |

FOREIGN PATENT DOCUMENTS

| | | | |
|---|---|---|---|
| JP | 63161685 | A | 7/1988 |
| JP | 2203553 | A | 8/1990 |
| JP | 2000077687 | A | 3/2000 |
| JP | 2001351789 | A | 12/2000 |
| JP | 200111907 | A | 1/2001 |
| JP | 2002208301 | A | 1/2001 |
| JP | 2002015606 | A | 1/2002 |
| JP | 2004111104 | A | 4/2004 |
| WO | 0101385 | A1 | 1/2001 |
| WO | 2003107423 | A1 | 12/2003 |

* cited by examiner

LIGHTING DEVICE EMPLOYING AC-DRIVEN LIGHT-EMITTING DIODES

FIELD OF THE INVENTION

The invention relates to a circuit comprising at least two parallel-connected light-emitting diodes of opposite pole in a first parallel branch and comprising at least two parallel-connected light-emitting diodes of opposite pole in a second parallel branch, and also comprising a capacitor and a coil.

BACKGROUND OF THE INVENTION it is known from WO 01/01385 to arrange light-emitting diodes in pairs and to use them as a lighting means for traffic lights. In order to limit the current and for an improved energy efficiency, use is made of coils and capacitors. Optionally, either a coil is connected in series with the light-emitting diodes and a capacitor is connected in parallel with the light-emitting diodes or the capacitor is connected in series with the light-emitting diodes and the coil is connected in parallel with the light-emitting diodes. The diodes are operated with an AC voltage of between 80 and 134 Volt and a number of diode pairs are connected in series. A diode emits light when it is operated in the transmitting direction. On account of the AC voltage, the diodes of the diode pairs thus emit light alternately. In each case only half of the diodes emit light, while the other half remain dark. The constant alternation manifests itself by flickering.

It is therefore an object of the invention to provide a simple circuit and a simple lighting device comprising light-emitting diodes. The aim is for the energy efficiency to be further improved. In particular, flickering is to be prevented as far as possible.

SUMMARY OF THE INVENTION

According to the invention, the first parallel branch has the capacitor and the second parallel branch has the coil. On account of the splitting into a capacitive branch and an inductive branch, idle currents arise which are phase-shifted. The idle currents can be compensated and cancel one another out. The current in the circuit thus corresponds to that of an ohmic consumer. A lighting means designed in this way behaves like an ohmic consumer and the energy efficiency is further improved. A diode switches and emits light in a current-dependent manner during a current half-wave. The first parallel branch is composed of a capacitive and an ohmic resistance which is brought about by the diodes, so that the current leads the voltage by a value of between 0° and 90°. The second parallel branch is composed of an inductive and an ohmic resistance which is brought about by the second diodes, so that the current lags behind the voltage by a value of between 0° and 90°. On account of the capacitive and inductive current shift, the light change takes place at different points in time. The light current is smoothed on account of the change carried out at different points in time. Coil and capacitor can be adapted to one another in such a way that the changes are phase-shifted by 90°. In particular, the inductive and capacitive branch can respectively be set to a phase angle of +45° and −45°. A light culmination point of one of the two parallel-connected light-emitting diodes of opposite pole of the first parallel branch is then located at a point in time at which one of the two parallel-connected light-emitting diodes of opposite pole of the second parallel branch switches on and the other switches off, that is to say during a zero crossing in the second parallel branch. Two parallel-connected diodes of opposite pole will be referred to below as an antiparallel-connected diode pair. If use is made of one diode pair per branch, the circuit can be operated with low secondary voltage values of up to around 12 Volt per branch.

Advantageously, the parallel branch has two diode chains or a series connection of a number of parallel-connected diodes of opposite pole. A number of diodes are thus connected in series behind one another, so that secondary voltage values of up to 50 Volt can be used.

Advantageously, a diode emits cold white, warm white, red or blue light. If the diodes are arranged in different branches and if currents can be changed within the branches, different-colored light or light of different color temperature can be set.

Advantageously, the diodes are arranged closely next to one another. The emitted light can no longer be assigned to the individual diodes and the four diodes of two diode pairs act as a central light source. The diodes are preferably arranged in a diamond-shaped manner.

A simple and advantageous lighting device for such a circuit has an electronic converter, the secondary frequency of which is adjustable. If use is made of light-emitting diodes which emit blue, red and white light, the light color can be adjusted by changing the frequency. If use is made of light-emitting diodes with different color temperatures, the color tone can be adjusted by changing the frequency.

BRIEF DESCRIPTION OF THE DRAWINGS

The invention will be further described with reference to examples of embodiments shown in the drawings to which, however, the invention is not restricted.

DETAILED DESCRIPTION

In the various figures, similar or identical elements bear the same references.

Figure 1:
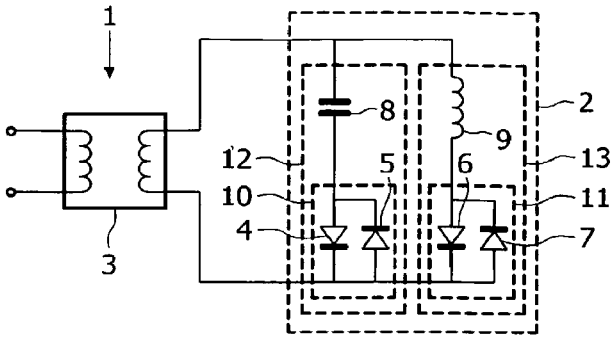
FIG. 1 shows a lighting device comprising a transformer and a diode circuit, which comprises diodes in an inductive and in a capacitive parallel branch.

FIG. 1 shows a lighting device 1 comprising a diode circuit 2 and a transformer 3. The diode circuit 2 comprises diodes 4-7, a capacitor 8 and a coil 9. The diodes 4 and 5 form a first diode pair 10 and the diodes 6 and 7 form a second diode pair 11. The diodes 4-7 of each diode pair 10 and 11 are connected in parallel and are of opposite pole, and hereinbelow this type of connection will also be referred to as antiparallel. The first diode pair 10 is connected in series with the capacitor 8 and forms a first parallel branch 12. The second diode pair is connected in series with the coil 9 and forms a second parallel branch 113. The diodes 4-7 are light-emitting diodes or LEDs. The transformer 3 of the lighting device 1, hereinafter also referred to as the lighting system, transforms the voltage from a conventional domestic supply voltage of 220 V AC to 12 Volt AC. This lighting system can be operated both with a halogen bulb and with the diode circuit, wherein the four light-emitting diodes 4-7 emit light instead of one halogen bulb.

Figure 2:
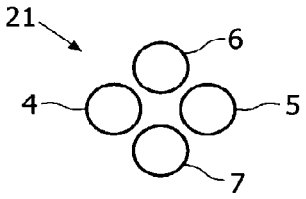
FIG. 2 shows a diamond-shaped arrangement of four light-emitting diodes.

FIG. 2 shows an arrangement 21 comprising four light-emitting diodes 4-7. The diodes 4-7 are arranged in a diamond-shaped manner and closely next to one another.

Figure 3:
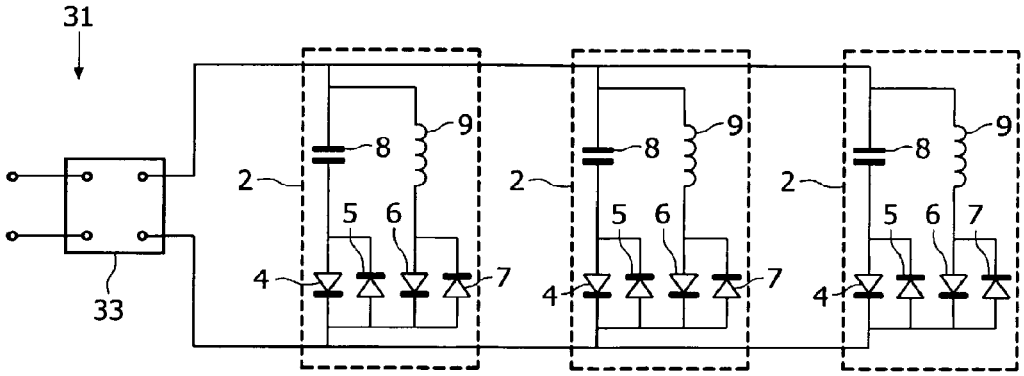
FIG. 3 shows a second lighting device comprising an electronic converter and comprising diodes in a number of inductive and capacitive parallel branches.

FIG. 3 shows a second lighting device 31 comprising an electronic converter 33 and three diode circuits 2, the four diodes 4-7 of which in each case form a light source. The output frequency of the electronic converter 33 is adjustable.

Figure 4:
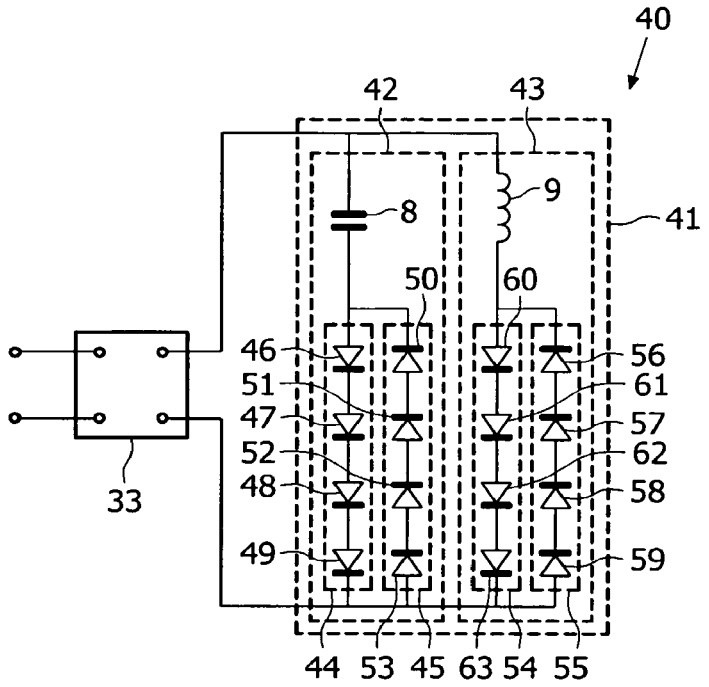
FIG. 4 shows a third lighting device comprising an electronic converter and comprising diode chains in the inductive and capacitive parallel branch.

FIG. 4 shows a lighting device 40 comprising the electronic converter 33 and a diode circuit 41. The diode circuit 41 has two parallel branches 42 and 43. The first parallel branch 42 comprises the capacitor 8 and two diode chains 44 and 45 having in each case four diodes 46-49 and 50-53. Of the diodes 46-53, in each case two form a diode pair. The second parallel branch comprises the coil 9 and two diode chains 54 and 55 having in each case four diodes 56-59 and 60-63.

Figure 5:
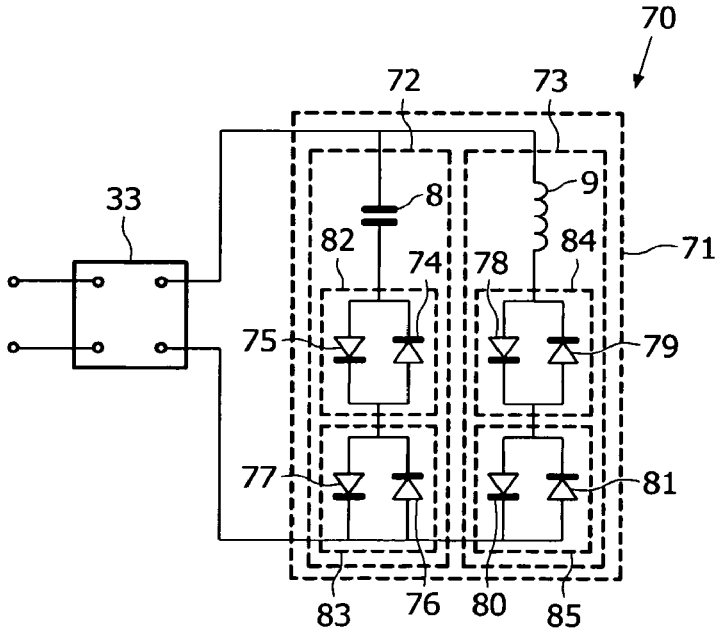
FIG. 5 shows a fourth lighting device comprising an electronic converter and comprising diode pairs connected in series in the inductive and capacitive parallel branch.

FIG. 5 shows a lighting device 70 comprising the electronic converter 33 and a diode circuit 71. The diode circuit 71 has two parallel branches 72 and 73. The first parallel branch 72 comprises the capacitor 8 and four diodes 74-77. The second parallel branch 73 comprises the coil 9 and four diodes 78-81. In each case two of the diodes 74-81 form an antiparallel-connected diode pair 82-85, and the diode pairs 82 and 83 are connected in series in the capacitive branch 72 and the diode pairs 84 and 85 are connected in series in the inductive parallel branch 73.

Figure 6:
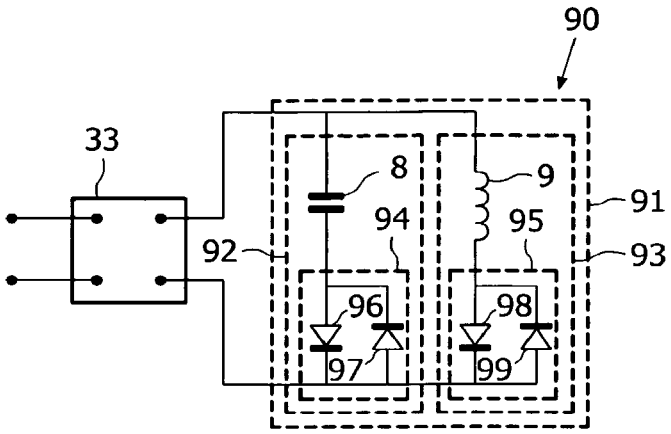
FIG. 6 shows a fifth lighting device comprising an electronic converter and comprising in each case one diode pair in the inductive and capacitive parallel branch, wherein the diode pairs produce white light of different temperature.

FIG. 6 shows a lighting device 90 comprising the electronic converter 33 and a diode circuit 91. The diode circuit 91 has two parallel branches 92 and 93 comprising the capacitor 8 and the inductor 9 and two diode pairs 94 and 95 having diodes 96-99. The first diode pair 94 transmits white light at 2500 K and the second diode pair 95 transmits white light at 5000 K. If the frequency is increased, more current flows in the capacitive branch 92 and less current flows in the inductive branch 93. More white is then transmitted at 2500 K and a warmer light color is thus emitted. At a lower frequency, a colder light color is emitted.

Figure 7:
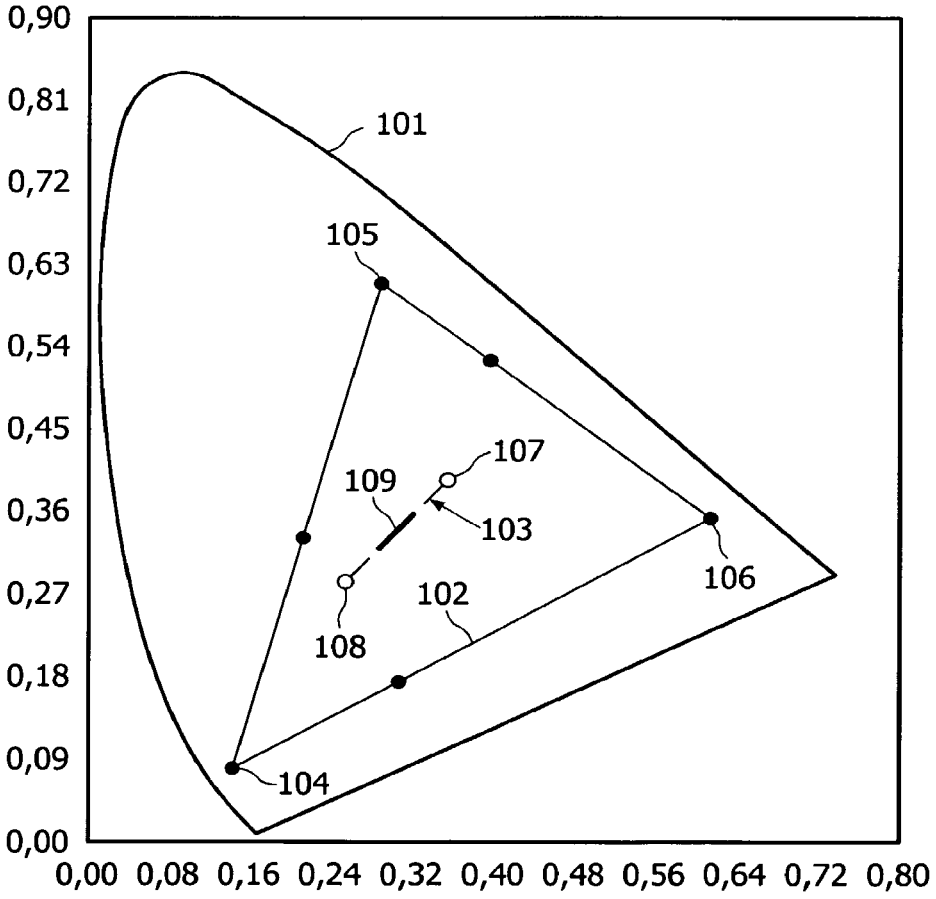
FIG. 7 shows a color diagram with a color temperature distribution of the diode pairs which emit white light of different temperature.

FIG. 7 shows a color diagram with curves 101, 102 and 103. In this color diagram, the 100% pure colors of the spectrum lie on the rounded boundary curve 101. The triangular curve 102 shows a color palette with three colors 104, 105 and 106, with which each color can be produced within the triangle 102. These color palettes are used for displayable colors of screen tubes and flat screens. The curve 103 has two end points 107 and 108 and a central region 109 and essentially covers a region of white light. The diode pair 94 emits white light at 2500 Kelvin; this light is defined by the point 107. The diode pair 95 emits white light at 5000 Kelvin; this light is defined by the point 108. The two white lights of the diode pairs 94 and 95 are mixed and a light can be emitted with a color temperature which is defined h a point of the central region 109 in a manner depending on the frequency. If the frequency is changed, white light of different temperature is thus emitted. The light color can be shifted.

Figure 8:
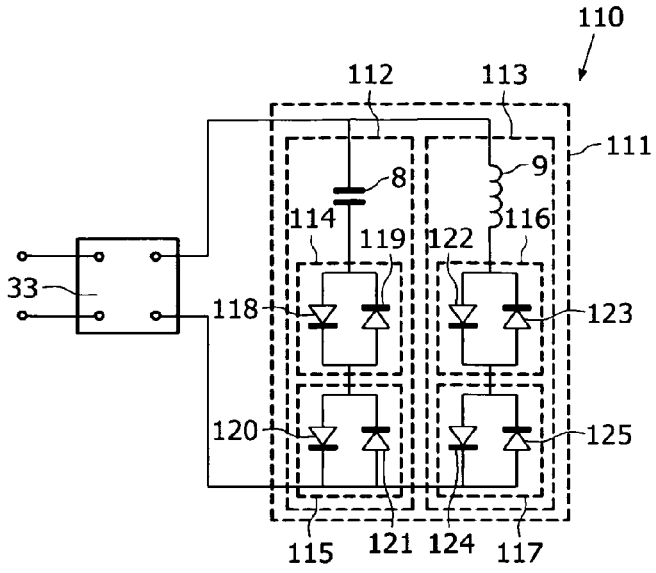
FIG. 8 shows a sixth lighting device comprising an electronic converter and comprising diode pairs in the inductive and capacitive parallel branch, wherein individual diode pairs produce white, red and blue light.

FIG. 8 shows a lighting device 110 comprising the electronic converter 33 and a diode circuit 111. The diode circuit 111 has two parallel branches 112 and 113 comprising the capacitor 8 and the inductor 9 and four diode pairs 114, 115, 116 and 117 having diodes 118-125. Each parallel branch 112 and 113 comprises one diode pair 115 and 117 which emits white light at 4000 Kelvin. The capacitive branch 112 comprises the diode pair 114 which emits red. light and the inductive branch 113 comprises the diode pair 116 which emits blue light. If the frequency is increased, more current flows in the capacitive branch 112 and less current flows in the inductive branch 113. The emitted white component of the light remains the same, but a warmer light color is achieved by virtue of the higher red component. At a lower frequency, the blue component of the emitted light is increased and thus a colder light color is emitted.

Figure 9:
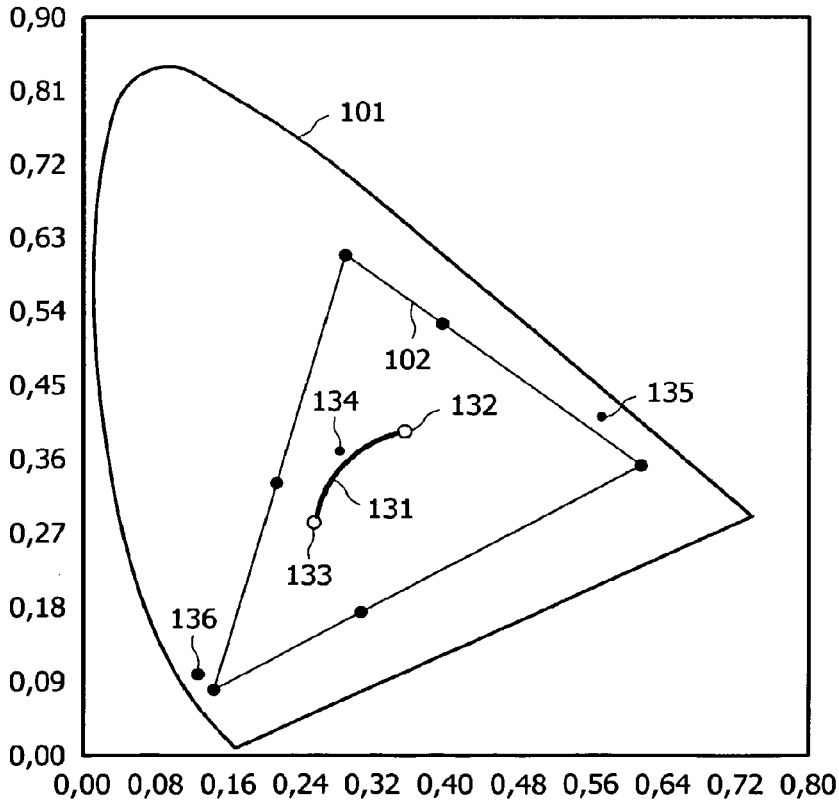
FIG. 9 shows a second color diagram with a second color temperature distribution of the diode pairs which emit white, red and blue light.

FIG. 9 shows a color diagram with the curves 101, 102 and a curve 131. The curve 131 has two end points 132 and 133, covers essentially a region of white light and defines a color range of the mixed light which can be achieved by means of the diode circuit 111. The diode pairs 115 and 117 emit white light, preferably with a green tinge; this light is defined by a white color point 134. The diode pair 114 emits red light; this light is defined by a red color point 135. The diode pair 116 emits blue light; this light is defined by a blue color point 136. By changing the frequency, a light can be emitted which is defined by a point on the curve 131.

Figure 10:
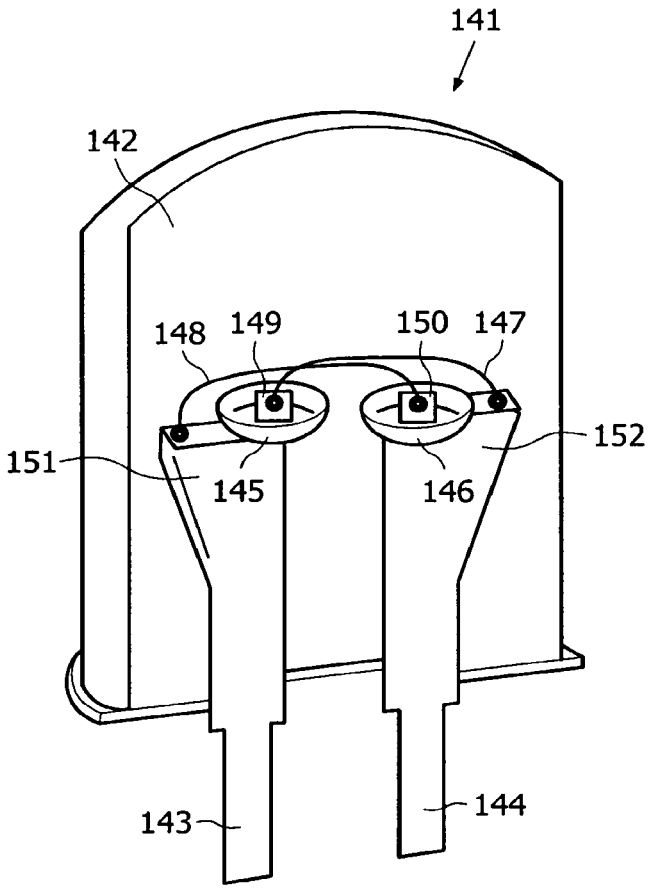
FIG. 10 shows a diode housing comprising one diode pair.

FIG. 10 shows a light-emitting diode 141 with a light-emitting diode housing 142, two current supply rods 143 and 144, two reflector cups 145 and 146, two electrically conductive connecting wires 147 and 148 and two LED chips 149 and 150. The two rods 143 and 144, which are arranged separately and in an electrically insulated manner in the housing 142, have upper ends 151 and 152. The cup 145 is seated on the end 151 and the cup 146 is seated on the end 152. The chip 149 is arranged in the cup 145 and the chip 150 is arranged in the cup 146. The electrically conductive wire 147, also referred to as the bond wire, leads from an upper surface of the chip 149 to the opposite rod 144 and the electrically conductive wire 148 leads from an upper surface of the chip 150 to the opposite rod 143. An antiparallel connection is achieved with this design.

LIST OF REFERENCE NUMERALS

| | | | |
|---|---|---|---|
| 1 | Lighting device | 58 | Diode |
| 2 | Diode circuit | 59 | Diode |
| 3 | Transformer | 60 | Diode |
| 4 | Diode | 61 | Diode |
| 5 | Diode | 62 | Diode |
| 6 | Diode | 63 | Diode |
| 7 | Diode | | |
| 8 | Capacitor | 70 | Lighting device |
| 9 | Coil | 71 | Circuit |
| 10 | First diode pair | 72 | Parallel branch |
| 11 | Second diode pair | 73 | Parallel branch |
| 12 | First parallel branch | 74 | Diode |
| 13 | Second parallel branch | 75 | Diode |
| | | 76 | Diode |
| 21 | Diode arrangement | 77 | Diode |
| 31 | Lighting device | 78 | Diode |
| 33 | Electronic converter | 79 | Diode |
| | | 80 | Diode |
| 40 | Lighting device | 81 | Diode |
| 41 | Circuit | 82 | Diode pair |
| 42 | Parallel branch | 83 | Diode pair |

-continued

| | | | |
|---|---|---|---|
| 43 | Parallel branch | 84 | Diode pair |
| 44 | Diode chain | 85 | Diode pair |
| 45 | Diode chain | | |
| 46 | Diode | 90 | Lighting device |
| 47 | Diode | 91 | Circuit |
| 48 | Diode | 92 | Parallel branch |
| 49 | Diode | 93 | Parallel branch |
| 50 | Diode | 94 | Diode pair |
| 51 | Diode | 95 | Diode pair |
| 52 | Diode | 96 | Diode |
| 53 | Diode | 97 | Diode |
| 54 | Diode chain | 98 | Diode |
| 55 | Diode chain | 99 | Diode |
| 56 | Diode | | |
| 57 | Diode | | |
| 101 | Boundary curve | 141 | Light-emitting diode |
| 102 | Triangular curve | 142 | Light-emitting diode housing |
| 103 | Curve | 143 | Current supply rod |
| 104 | Color | 144 | Current supply rod |
| 105 | Color | 145 | Reflector cup |
| 106 | Color | 146 | Reflector cup |
| 107 | End point | 147 | Connecting wire |
| 108 | End point | 148 | Connecting wire |
| 109 | Central region | 149 | LED chip |
| 110 | Lighting device | 150 | LED chip |
| 111 | Diode circuit | 151 | Rod end |
| 112 | Parallel branch | 152 | Rod end |
| 113 | Parallel branch | | |
| 114 | Diode pair | | |
| 115 | Diode pair | | |
| 116 | Diode pair | | |
| 117 | Diode pair | | |
| 118 | Diode | | |
| 119 | Diode | | |
| 120 | Diode | | |
| 121 | Diode | | |
| 122 | Diode | | |
| 123 | Diode | | |
| 124 | Diode | | |
| 125 | Diode | | |
| 131 | Curve | | |
| 132 | End point | | |
| 133 | End point | | |
| 134 | White color point | | |
| 135 | Red color point | | |
| 136 | Blue color point | | |

The invention claimed is:

1. A lighting device, comprising:

an electronic converter; and a circuit connected to an output of the electronic converter, the circuit comprising at least two parallel-connected light-emitting diodes of opposite pole in a first parallel branch and comprising at least two parallel-connected light-emitting diodes of opposite pole in a second parallel branch, and also comprising a capacitor and a coil, wherein the first parallel branch includes the capacitor and the second parallel branch includes the coil, wherein the light-emitting diodes of the first parallel branch emit white light having a first color temperature, wherein the light-emitting diodes of the second parallel branch emit white light having a second color temperature different from the first color temperature, and wherein an output frequency at the output of the converter is adjusted to adjust a ratio of an amount of the white light having the first color temperature and an amount of the white light having the second color temperature.

2. The lighting device of claim 1, wherein at least one of the parallel branches includes two diode chains.

3. The lighting device of claim 1, wherein at least one of the parallel branches includes a series connection of a number of parallel-connected diodes of opposite pole.

4. The lighting device of claim 1, wherein at least one of the diodes emits cold white light.

5. The lighting device of claim 1, wherein at least one of the diodes emits warm white light.

6. The lighting device of claim 1, wherein at least one of the diodes emits red light.

7. The lighting device of claim 1, wherein at least one of the diodes emits blue light.

8. The lighting device of claim 1, wherein an output frequency at the output of the electronic converter is adjustable.

9. The lighting device of claim 8, wherein the lighting device is configured to emit first white light when the output frequency has a first value, and to emit second white light when the output frequency has a second value, wherein the first white light is warmer than the second white light.

10. The lighting device of claim 1, wherein the at least two parallel-connected light-emitting diodes of opposite pole in the first parallel branch include a first pair of parallel-connected light-emitting diodes of opposite pole in series with a second pair of parallel-connected light-emitting diodes of opposite pole, and wherein the at least two parallel-connected light-emitting diodes of opposite pole in the second parallel branch include a third pair of parallel-connected light-emitting diodes of opposite pole in series with a fourth pair of parallel-connected light-emitting diodes of opposite pole, wherein the first and third pairs of parallel-connected light-emitting diodes of opposite pole are each configured to emit white light, wherein one of the second pair and fourth pair of parallel-connected light-emitting diodes of opposite pole is configured to emit red light, and wherein another of the second pair and fourth pair of parallel-connected light-emitting diodes of opposite pole is configured to emit blue light.

11. A method, comprising:

providing a lighting device, comprising: an electronic converter; and a circuit connected to an output of the electronic converter, the circuit comprising at least two parallel-connected light-emitting diodes of opposite pole in a first parallel branch and comprising at least two parallel-connected light-emitting diodes of opposite pole in a second parallel branch, and also comprising a capacitor and a coil, wherein the first parallel branch includes the capacitor and the second parallel branch includes the coil, wherein the light-emitting diodes of the first parallel branch emit white light having a first color temperature, and wherein the light-emitting diodes of the second parallel branch emit white light having a second color temperature different from the first color temperature; and adjusting an output frequency at the output of the converter to adjust a ratio of an amount of the white light having the first color temperature and an amount of the white light having the second color temperature which is emitted by the lighting device.

12. The method of claim 11, wherein the lighting device is configured to emit first white light when the output frequency has a first value, and to emit second white light when the output frequency has a second value, wherein the first white light is warmer than the second white light.

* * * * *